United States Patent [19]

Hall

[11] 4,037,524

[45] July 26, 1977

[54] APPARATUS FOR COMBINING A TUBE WITH A CIGARETTE FILTER

[75] Inventor: Floyd Vanmeda Hall, Durham, N.C.

[73] Assignee: Liggett Group Inc., Durham, N.C.

[21] Appl. No.: 740,030

[22] Filed: Nov. 8, 1976

[51] Int. Cl.[2] ..... A24C 5/50

[52] U.S. Cl. ..... 93/77 FT; 131/10.5

[58] Field of Search ..... 93/1 C, 77 FT; 131/10.5, 261 B, 264, 10 R, 10 A, 10.3

[56] References Cited

U.S. PATENT DOCUMENTS

| | | | |
|---|---|---|---|
| 2,820,460 | 1/1958 | Bunzl et al. | 131/261 B |
| 3,357,321 | 12/1967 | Hall | 93/1 C |
| 3,811,451 | 5/1974 | Berger | 131/10.5 X |
| 3,860,011 | 1/1975 | Norman | 131/10.5 |
| 3,910,288 | 10/1975 | Hammersmith et al. | 131/261 B X |

*Primary Examiner*—James F. Coan

*Attorney, Agent, or Firm*—J. Bowen Ross, Jr.; Michael L. Hendershot

[57] ABSTRACT

The machine produces a filter rod made up of a cylinder of tow and spaced apart hollow plastic tubes within the tow. The machine includes a means for supplying a continuous tow stream to an injection station below a rotatable wheel which delivers the plastic tubes in spaced apart fashion. Plungers on the wheel eject the tubes from the wheel and positively push the ejected tubes into the cylinder of tow at the injection station. The tubes are cut from a continuous tubing by means of a cutter which is timed with respect to the operation of the machine. The cut tubes are initially pushed forward on the wheel by a pushing roll and thereafter slid backwardly by a cover so as to be properly positioned for injection into the tow.

17 Claims, 8 Drawing Figures

APPARATUS FOR COMBINING A TUBE WITH A CIGARETTE FILTER

This invention relates to a filter making machine. More particularly, this invention relates to a machine for making filter rods composed of tow with a hollow tube therein.

Heretofore, it has been known to manufacture filter rods of tow or cellulose acetate material in continuous form. Generally, in these cases, the tow is delivered through a funnel-like structure and formed into a tubular shape and then wrapped within paper. It has also been known to manufacture filter rods with a hollow tube extending through the rods, for example, as described in U.S. Pat. No. 3,860,011.

It is an object of this invention to provide a filter rod wherein hollow tubes are placed in spaced apart relation within a cylinder of tow.

It is another object of the invention to provide a filter rod for making filters with a hollow tube disposed at one end only of the filter.

It is another object of the invention to provide a means of accurately placing spaced apart hollow tubes within a continuous cylinder of tow.

Briefly, the invention provides a filter making machine which is comprised of a means for supplying a continuous length of tow to an injection station, a means for supplying spaced apart tubes to the injection station, means for positively moving each tube into the tow at the injection station and means for wrapping paper about the tow and the injected tubes to form a continuous filter rod with longitudinally spaced apart tubes therein.

The means for supplying the spaced apart tubes includes a rotatable wheel which is provided with recesses, a means for supplying a continuous length of tubing to the wheel via a feed tube, and a cutter adjacent to the feed tube for cutting short lengths from the tubing to form the tubes. The feed tube and cutter are arranged at an upper portion of the wheel so that the cut lengths of tubes can drop under gravity into the recesses of the wheel. In addition, suitable means are provided for accurately positioning the tubes within the respective recesses to ensure proper positioning in the final filter rod.

The means for moving the tubes into the tow at the injection station includes a plurality of plungers which are disposed on the wheel in alignment with each recess as well as cam means for moving the plungers into a respective recess at the injection station to expel a tube into the tow.

In order to properly position the tubes in the respective recesses, a pushing roll is positioned downstream of the cutter in order to positively move the tubes forwardly within each recess. In this respect, each recess is of greater length than the tube to permit moving of the tubes in a forward sense. In addition, a cover is disposed about the wheel to extend from the pushing roll. This cover is spaced from the wheel a sufficient amount to impart a slight friction force on each tube. This causes the tube to be slid to the rear of each recess under the friction force generated on the cover. Thus, each tube is accurately positioned against the rear wall of the respective recess before coming into the injection station.

These and other objects and advantages of the invention will become more apparent from the following detailed description and appended claims taken in conjunction with the accompanying drawings in which:

Figure 1:
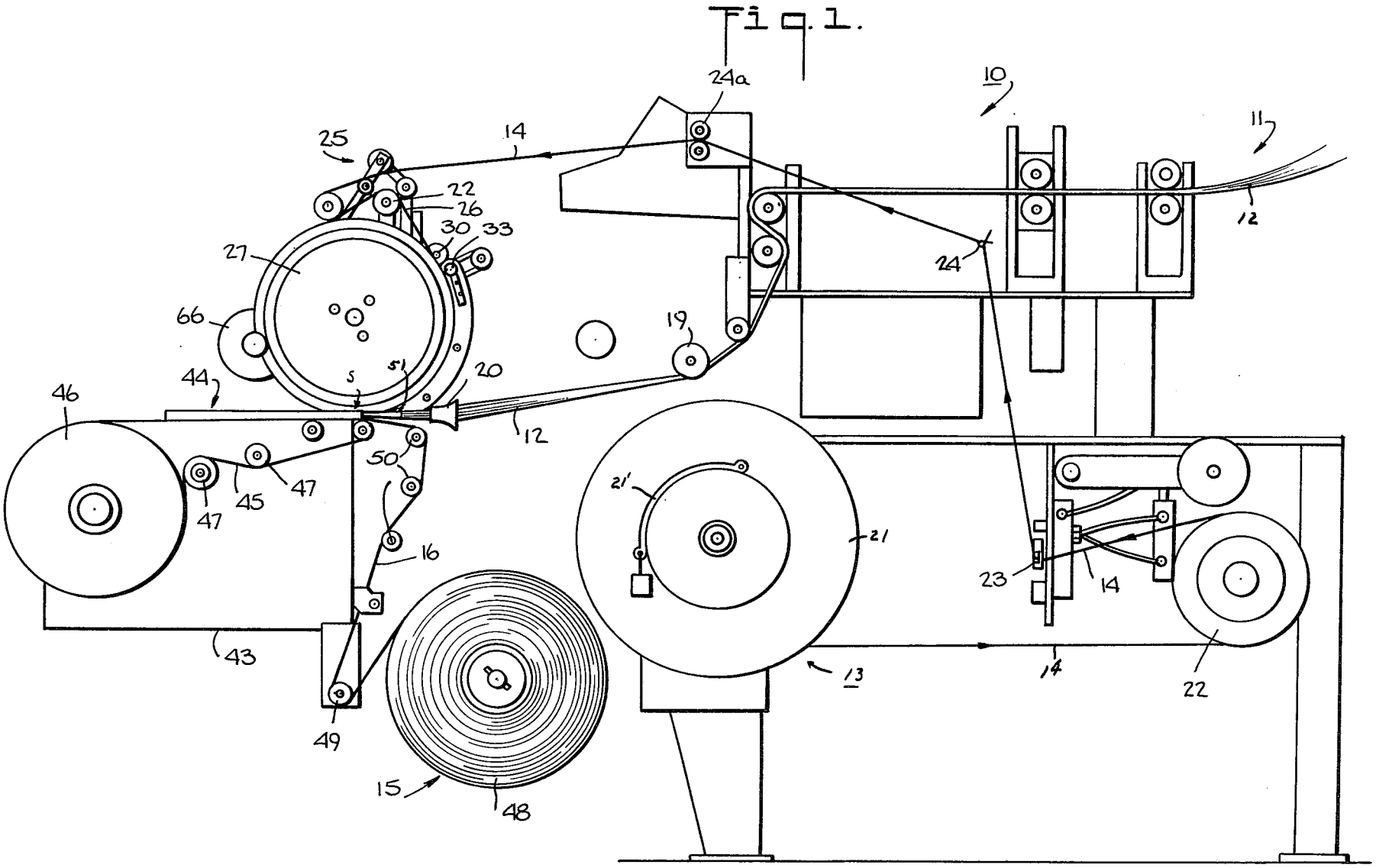
FIG. 1 illustrates a filter making machine according to the invention.

Referring to FIG. 1, the filter making machine 10 includes a means 11 for supplying tow 12, a means 13 for supplying a continuous length of tubing 14 and a means 15 for supplying paper 16 for wrapping around the supplied tow 12 and spaced apart tubes 17 (FIG. 8) which have been cut from the tubing 14 in order to form a continuous filter rod 18.

The means 11 for supplying the tow 12 is of any suitable conventional structure and need not be further described. In this regard, the tow 12 is supplied from a suitable source (not shown) and passes in a layer-like manner into the machine 10 and is thereafter processed and guided over suitable guide rolls 19 into a funnel-like member 20 to be formed into a shape having a circular cross-section. The tow 12 then passes through an injection station 5 in which the tubes 17 cut from the tubing 14 are embedded in the tow 12.

The means 13 for supplying the tubing 14 includes a tubing supply roll 21 on which a coil of hollow plastic tubing is mounted. This roll 21 is rotatably mounted so as to be replaced from time to time and cooperates with a suitable brake means 21' which controls the pay-out of the tubing 14. In addition, a metering roll 22 is mounted on the machine 10 to pull the tubing 14 from the supply roll 21 under a controlled tension. For this purpose, a tension feeler 23 is interposed in the path of the tubing 14 between the metering roll 22 and a tensioning device 25. The tension feeler 23 operates in any known manner to control the rotation of the metering roll 22 in dependence on the tension in the tubing 14 between the supply roll 21 and tensioning device 25. The tubing 14 also passes through guide eyelet 24 in the machine 10 before passing between a pair of guide rolls **24*a***.

Figure 2:
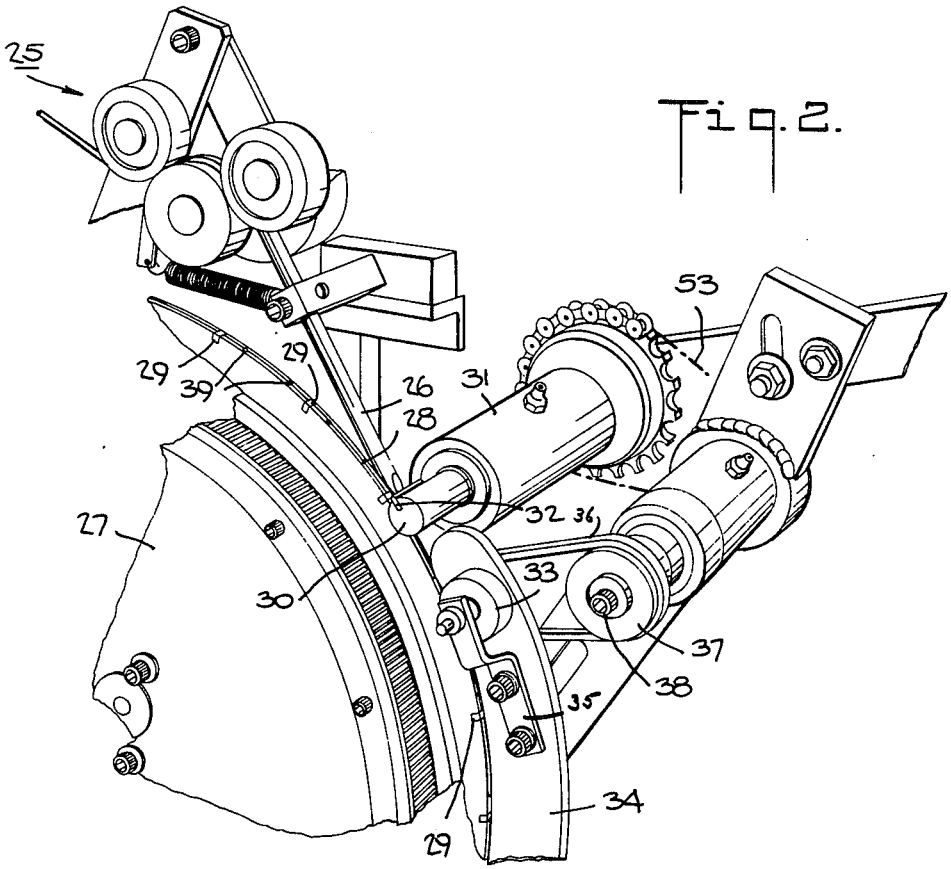
FIG. 2 illustrates a partial perspective view of a means for supplying tubing to the machine.
Figure 6:
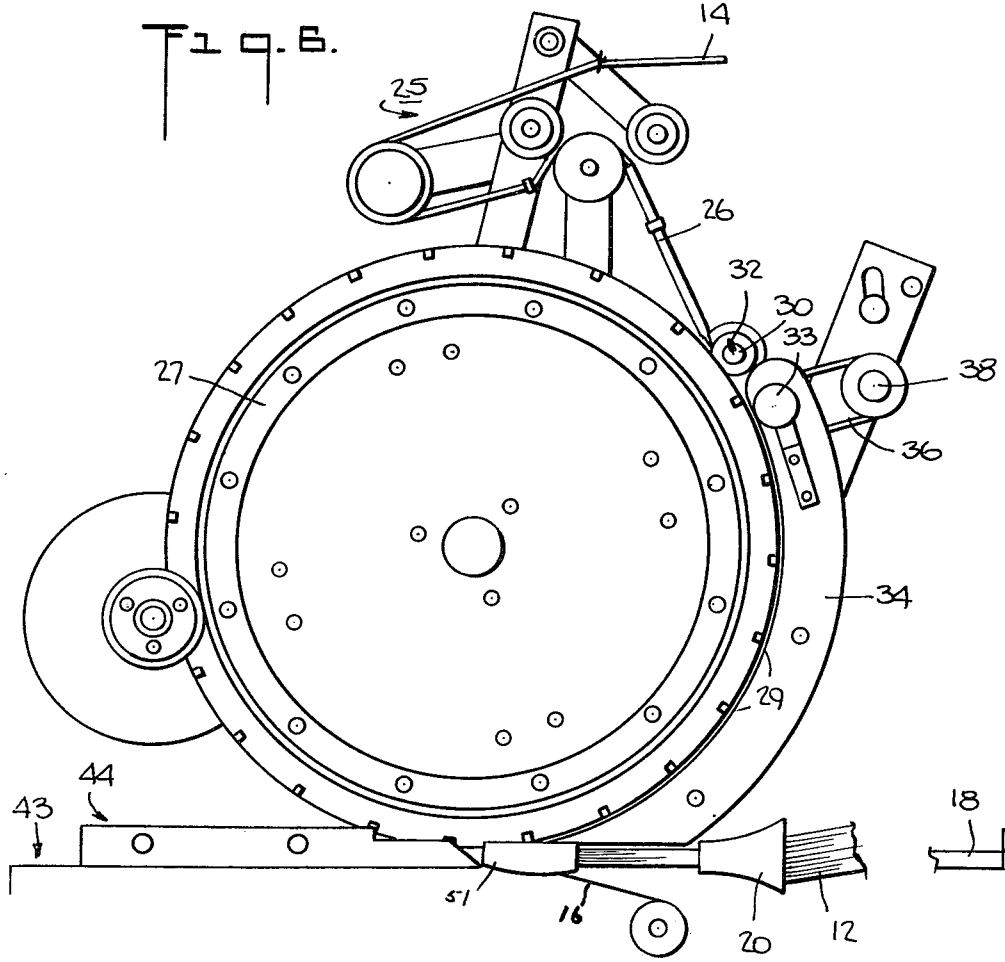
FIG. 6 illustrates a side view of the means for moving each tube into the tow at the injection station.

The means 13 for supplying the tubing to the injection station S also includes the tensioning device 25 (as shown in FIGS. 1 and 2) which imparts a suitable tension to the tubing 14 for processing. As shown in FIG. 2, the tensioning device 25 has a feed tube 26 through which the forward end of the tubing 14 passes to a rotatable wheel 27. The rotatable wheel 27 is mounted about a horizontal axis and is located above the injection station (FIG. 1). The wheel 27 includes a plurality of peripherally spaced recesses 28 (FIG. 4) which are defined by a plurality of spaced apart mandrels 29 fixedly mounted in the periphery of the wheel 27. As indicated in FIG. 6, the feed tube 26 extends tangentially with respect to the wheel 27.

Figure 4:
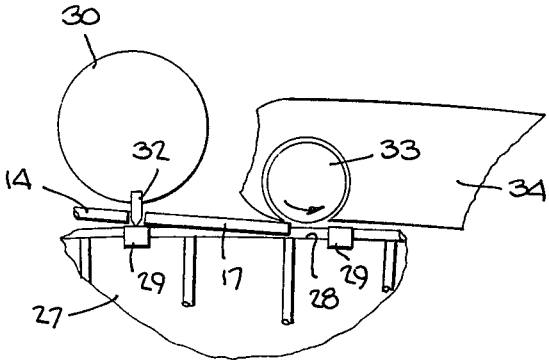
FIG. 4 illustrates a fragmentary view of a cutter and pushing roll according to the invention at a time at which a tube is initially moved into a recess of the wheel.

A means is provided adjacent to the outlet of the feed tube 26 for cutting the tubing 14 into short lengths to form the tubes 17. As shown in FIG. 2, this means includes a rotatable shaft 30 which is journalled in a housing 31 on the machine 10 and a cutting blade 32 which is mounted in the periphery of the shaft 30. As indicated in FIG. 4, the shaft 30 is synchronized to the operation of the machine to move the blade 32 into cutting relationship with a respective mandrel 29 on the wheel 26 to cut the tubing 14 therebetween. In addition the tubing 14 is fed by the metering roll 22 at a slower speed than the peripheral speed of the wheel 27 so that a spacing is obtained between successive tubes 17.

Referring to FIGS. 2 and 4, a pushing roll 33 is mounted on the machine 10 for pushing each cut tube 17 into a recess 28 of the wheel. This pushing roll 33 moves at a greater peripheral speed than the peripheral speed of the wheel 27 so as to push the tube 17 against the forward mandrel 29 and away from the cutter blade 32. As indicated in FIG. 4, the pushing roll 33 is spaced from the cutter blade 32 by a distance sufficient to permit grasping of the forward end of the tube 17 immediately prior to a cut to positively move the tube 17 away from the mandrel 29 subsequent to a cut having been made. Because of the greater speed of the pushing roll 33, the tube is positively pulled forward against the forwardmost mandrel 29 of the recess 28.

Figure 5:
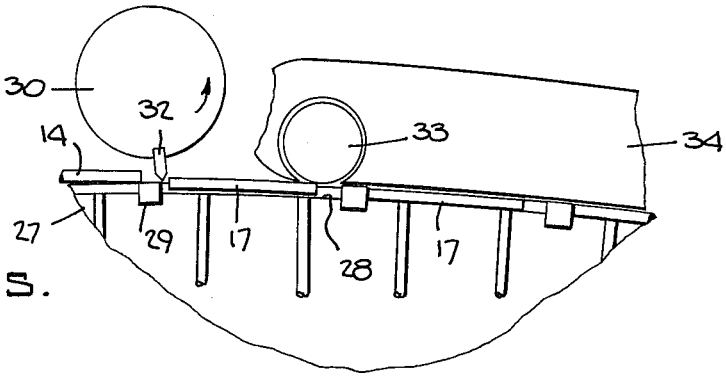
FIG. 5 illustrates a view similar to FIG. 4 at a time when a tube is moved under the influence of the pushing roll.

Referring to FIG. 5, a cover or shroud 34 is disposed over the wheel 27 which extends from the pushing roll 33. The cover 34 is spaced from the wheel 27 a distance which is less than the diameter of the tube 17 so that the tube 17 comes into a slight frictional contact with the cover 24. In this way, as the wheel 27 rotates, the tube 17 slides along the cover 34 and is pushed back against the rearmost mandrel 29 of the recess 28. In addition, any suitable means may be mounted in the path of the tubes 17 to ensure movement against the rear mandrel 29, e.g. a spring or air jet may be disposed in the cover 34 to urge the tubes rearward.

As shown in FIG. 2, the pushing roll 33 is mounted by a suitable bracket 35 on the cover 34 so as to be adjusted with the cover 34. In addition, the pushing roll 33 is driven via a transmission belt 36 from a pulley wheel 37 on a drive shaft 38.

Figure 7:
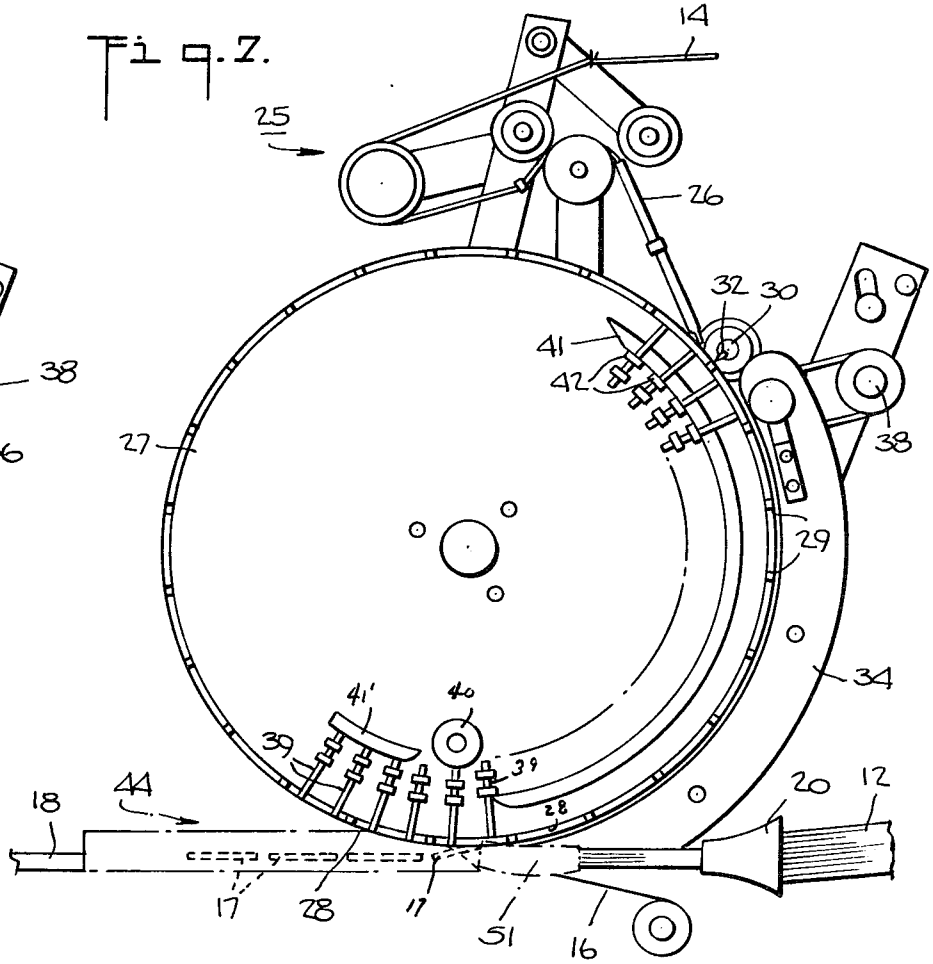
FIG. 7 illustrates a partially broken away view of the wheel of FIG. 6.

Referring to FIG. 7, a means is provided on the wheel 27 for expelling the tubes 17 from the respective recesses 28 into the cylinder of tow 12 at the injection station S. As shown, this means constitutes a plurality of plungers 39 which are mounted in a radial fashion at the periphery of the wheel 27. Each plunger 39 is slidably mounted within the wheel 27 in a known fashion and cooperates with two cams 40, 41 so as to be moved radially outwardly and radially inwardly. As shown, one cam 40 which is in the form of a rotatably mounted roller is positioned on a fixed axis relative to the wheel 27 near the injection stat S while the other cam 41 is in the form of an elongated bar which is positioned in a fixed manner with respect to the wheel 27 and cooperates with a shoulder 42 on each plunger 39 to positively retract the plunger 39 radially into the wheel 27 so as to avoid obstructing the placement of the tubes 17 into the respective recesses 28. The construction of the wheel 27 is similar to that as described in U.S. Pat. No. 3,357,321 and no further description is believed to be necessary. During operation, as each plunger 39 moves under the roller cam 40 at the injection station S, the plunger is released by the cam 41 and is then moved outwardly by the cam 40 so as to positively move the tube 17 from the recess 28 into the tow 12. As shown, two plungers 39 are associated with each recess 28. Thus, the foremost plunger 39 of each recess 28 serves to push the front end of a tube 17 into the tow 12 (see FIG. 7) before the rearmost plunger 39 pushes the rear end of the tube 17 into the tow 12. In this way, any tendency that the tube 17 may have a stick in the recess 28, for example due to static friction, is positively overcome.

A further cam 41' may also be fixedly mounted relative to the wheel 27 downstream of the roller cam 40 in order to positively hold the plungers 39 in the expelled position.

Referring to FIG. 1, the machine 10 includes a table 43 on which a known garniture and sealing section 44 is mounted in known fashion to receive the tow 12 and the tubes 17 fed from the wheel 27. As shown, the table 43 supports a conveyor belt 45 which is driven from a drive roll 46 over various guide rolls 47 in order to convey the paper 16, tow 12 and encased tube 17.

The paper 16 is supplied from a paper roll 48 which can be replaced from time to time and is delivered to the machine 10 via a paper idler roll 49 and suitable guide rolls 50. As indicated, the paper 16 is delivered to the garniture section 44 at a point near the injection station S.

As shown in FIg. 7, a sleeve 51 is provided at the injection station S to form the tow 12 into a shape to receive the tubes 17. The sleeve 51 is positioned so as to hold the tow 12 against the shroud 34 and is shaped to guide the tow 12 about the shroud 34 in a manner to receive the tubes 17. To this end, the sleeve 51 which is shown schematically is split along the upper surface and has an upstream open cone or trumpet shaped portion to fit about the shroud 34 and a downstream open cylinder shaped portion below the wheel 27 which extends to a point upstream of the injection station S. The sleeve 51 is adjustably mounted relative to the wheel 27 so as to permit centering of the tubes 17 in the tow 12.

Figure 3:
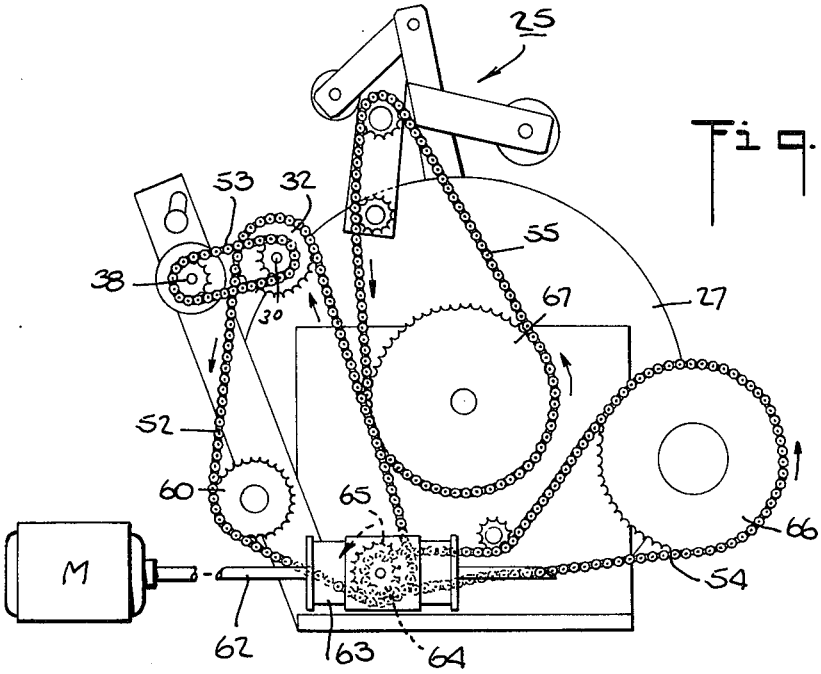
FIG. 3 illustrates a timing mechanism for the machine according to the invention.

Referring to FIG. 3, the various moving mechanisms of the machine 10 are synchronized with respect to each other by a suitable transmission. To this end, the transmission drives the tensioning device 25 for the tubing 14 at a speed slower than the speed of the wheel 27 so that the tubing 17 is fed at a slower rate than the speed of the wheel 27. In addition, the cutter shaft 30 is timed to the speed of the wheel 27 so as to effect movement of the cutter blade 32 against each successive mandrel 29. Similarly, the pushing roll 33 is synchronized to move faster than the wheel 27 in order to receive and push the tube 17 along the wheel 27 periphery. As shown in FIG. 3, the cutter shaft 30 is driven in proportional relationship to the wheel 27 via an endless chain 52 off a main gear 65. In similar fashion, the shaft 38 for the pushing roll 33 is driven off the shaft 30 of the cutter blade 32 by an endless chain 53 at a speed which is greater than the speed of the cutter shaft 30. The transmission includes an idler sprocket wheel 60 over which the chain 52 passes as well as a drive motor M, a motor drive shaft 62, and a gear box 64 into which the drive shaft 52 passes to drive the main gears 64, 65 off which the chain 52 and a chain 54 for driving the wheel 27 via a sprocket gear 66 are driven. A chain 55 is also provided to drive the tensioning device 25 off a sprocket gear 67 fixed relative to the wheel 27. The construction of the transmission is of known construction and need not be further described.

Figure 8:
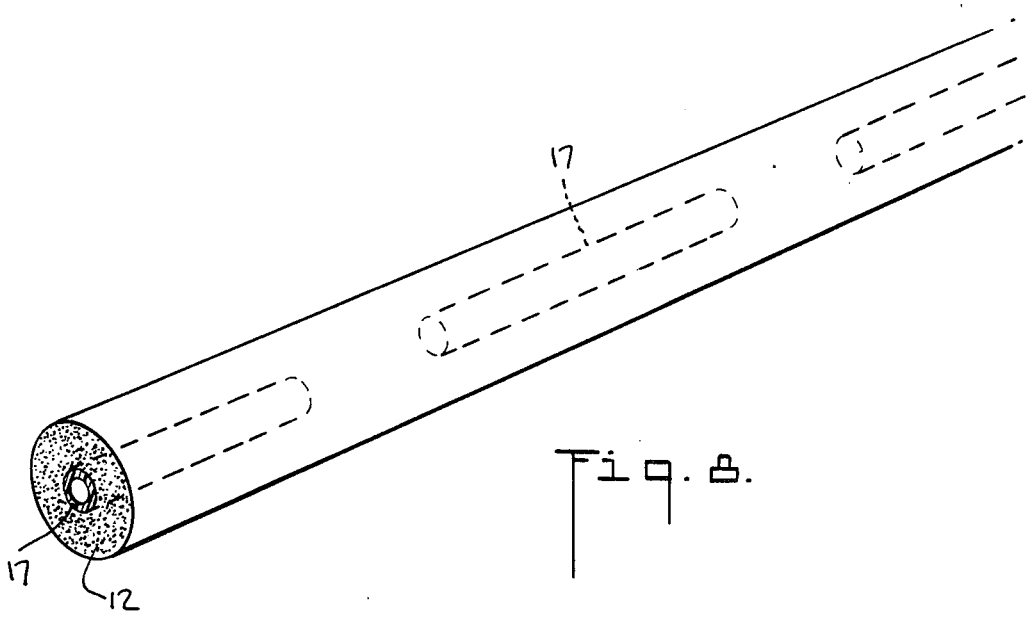
FIG. 8 illustrates a view of a fitter rod produced by the machine of FIg. 1.

In operation, the tubing 14 is supplied via the metering roll 22 and tensioning device 25 into the feed tube 26 and then passed tangentially towards the wheel 27. The cutting blade 32 then severs a short length 17 from the forward end of the tubing 14 (FIG. 4). At the same time, the pushing roll 33 engages the forward end of the severed tube 17 and pulls the tube 17 after cutting forwardly against the forward mandrel 29 of the recess 28. Next, as the wheel 27 continues to rotate, the tube 17 passes into friction contact with the cover 34 downstream of the pushing roll 33. The cover 34 then causes the tube 17 to slide to the rear against the rearmost mandrel 29 of the recess 28 (FIG. 5). Continued rotation of the wheel 27 carries the tube 17 while against the rear mandrel to the injection station S. At this station, the foremost plunger 39 of the pair of plungers 39 aligned with the recess 28 is moved outwardly by the roller cam 40 to force the front end of the tube 17 into the tow 12 which has been delivered by the tow supply means 13 (FIG. 7) and shaped by the sleeve 51 and cover 34. Continued wheel rotation causes the rearmost plunger 39 to move outwardly under the influence of the roller cam 40 to complete ejection of the tube 17. Shortly thereafter, the paper 16 which is delivered by the paper supply means 15 is enveloped about the tow 12 and embedded tubes 17 in the garniture and sealing section 44 as is known. In this way, a filter rod 18 is formed of the tow 12 and successively delivered spaced apart tubes 17 (FIG. 8). The conveyor belt 45 then carries the filter rod 18 to a discharge end of the machine 10 in known fashion.

Since the tubes 17 are delivered in precise positions in a timed sequence, the machine is able to make filter rods of tow material which contain accurately spaced apart hollow tubes. As described, the tubing 14 may be made of any suitable plastic material such as a polyethylene tube.

The continuous filter rod which is made by the machine may be processed in any suitable known manner, for example by cutting into multi-length filters for subsequent cutting into individual filters for cigarettes.

What is claimed is;

1. A filter making machine comprising means for supplying a continuous supply of tow to an injection station;

means for supplying spaced apart tubes to said injection station;

means for positively moving each tube into said tow at said injection station; and means for wrapping paper about said tow and injected tubes downstream of said injection station to form a continuous filter rod with longitudinally spaced apart tubes therein.

2. A filter making machine as set forth in claim 1 wherein said means for supplying the tubes includes a rotatable wheel having a plurality of recesses in the periphery thereof for receiving a sequence of spaced apart tubes.

3. A filter making machine as set forth in claim 1 wherein said means for positively moving each tube into said tow includes a plurality of plungers disposed on said wheel near said periphery and in alignment with each respective recess, and cam means for moving each plunger into a respective recess at said injection station to expel a tube therein into said tow.

4. A filter making machine as set forth in claim 2 which further comprises a feed tube for feeding a continuous length of tubing to said wheel upstream of said injection station and a cutter for cutting the tubing into discrete tubes for depositing of each tube into a respective recess of said wheel.

5. A filter making machine as set forth in claim 4 which further comprises a plurality of pairs of peripherally spaced mandrels on said wheel, each pair of said mandrels defining a respective one of said recesses therebetween, and wherein said cutter cooperates with each said mandrel successively to cut the tubing.

6. A filter making machine as set forth in claim 5 which further comprises a rotatable pushing roll adjacent said wheel and downstream of said cutter for pushing a cut tube from the tubing towards a forward mandrel of a respective recess.

7. A filter making machine as set forth in claim 6 which further comprises a cover about said wheel and extending from said pushing roll in closely spaced relation to said wheel to slide each tube in a respective recess towards the rear mandrel of said recess.

8. A filter making machine as set forth in claim 7 wherein said cutter and said pushing roll are synchronized to each other.

9. In a filter making machine the combination of a rotatable wheel having a plurality of peripheral recesses;

means for depositing a tube each of said recesses;

means for supplying a continuous supply of tow to an injection station under said wheel; and means for expelling each tube from a respective recess into the tow at said injection station.

10. The combination as set forth in claim 9 which further comprises a rotatable pushing roll adjacent said wheel for pushing a tube in a respective recess toward a forward end of said recess and a cover about said wheel and extending from said roll to slide each tube in a respective recess towards the rear of said recess.

11. The combination as set forth in claim 10 said means for expelling each tube into said tow includes a plurality of plungers disposed on said wheel near said periphery and in alignment with each respective recess, and cam means for moving each plunger into a respective recess at said injection station to expel a tube therein into said tow.

12. The combination as set forth in claim 10 which further comprises a feed tube for feeding a continuous length of tubing to said wheel upstream of said pushing roll and a cutter between said feed tube and said pushing roll for cutting the tubing into discrete tubes for depositing of each tube into a respective recess of said wheel upstream of said pushing roll.

13. The combination as set forth in claim 12 which further comprises a plurality of pairs of peripherally spaced mandrels on said wheel, each pair of said mandrels defining a respective one of said recesses therebetween, and wherein said cutter cooperates with each said mandrel successively to cut the tubing.

14. The combination as set forth in claim 10 which further comprises means for wrapping paper about said tow and injected tubes downstream of said injection station to form a continuous filter rod with longitudinally spaced apart tubes therein.

15. A filter making machine comprising means for supplying a continuous supply of tow to an injection station;

a rotatable wheel above said injection station and having a plurality of recesses in the periphery thereof for receiving a sequence of spaced apart tubes;

a feed tube for feeding a continuous length of tubing to said wheel upstream of said injection station;

a cutter for cutting the tubing into discrete tubes for depositing of each tube into a respective recess of said wheel;

a plurality of plungers disposed on said wheel in alignment with each respective recess;

cam means for moving each plunger into a respective recess at said injection station to expel a tube therein into said tow; and means for wrapping paper about said tow and injected tubes downstream of said injection station to form a continuous filter rod with longitudinally spaced apart tubes therein.

16. A filter making machine as set forth in claim 15 which further comprises a plurality of pairs of peripherally spaced mandrels on said wheel, each pair of said mandrels defining a respective one of said recesses therebetween, and wherein said cutter cooperates with each said mandrel successively to cut the tubing.

17. A filter making machine as set forth in claim 16 which further comprises a rotatable pushing roll adjacent said wheel and downstream of said cutter for pushing a cut tube from the tubing towards a forward mandrel of a respective recess and a cover about said wheel and extending from said pushing roll in closely spaced relation to said wheel to slide each tube in a respective recess towards the rear mandrel of said recess.

* * * * *